US007416251B2

(12) United States Patent
Chu

(10) Patent No.: US 7,416,251 B2
(45) Date of Patent: Aug. 26, 2008

(54) CHAIR

(75) Inventor: Zooey Chia-Tien Chu, Grand Rapids, MI (US)

(73) Assignee: Global Total Office, Downsview, ON (CA)

( * ) Notice: Subject to any disclaimer, the term of this patent is extended or adjusted under 35 U.S.C. 154(b) by 321 days.

(21) Appl. No.: 11/149,774

(22) Filed: Jun. 10, 2005

(65) Prior Publication Data

US 2006/0279126 A1 Dec. 14, 2006

(51) Int. Cl.
*A47C 3/00* (2006.01)

(52) U.S. Cl. ..... 297/285; 297/296; 297/299

(58) Field of Classification Search ..... 297/285, 297/296, 299
See application file for complete search history.

(56) References Cited

U.S. PATENT DOCUMENTS

| | | | | |
|---|---|---|---|---|
| 1,827,928 | A * | 10/1931 | Berger | 297/291 |
| 2,460,596 | A | 2/1949 | Roche | |
| 2,554,490 | A * | 5/1951 | Eames | 297/301.1 |
| 2,649,136 | A * | 8/1953 | Eames | 297/295 |
| 2,685,425 | A | 8/1954 | Wallerstein, Jr. | |
| 3,309,137 | A | 3/1967 | Wiebe | |
| D247,463 | S | 3/1978 | Muller-Deisig | |
| D254,278 | S | 2/1980 | Wilson | |
| D267,989 | S | 2/1983 | Buhk et al. | |
| D272,205 | S | 1/1984 | De Boer | |
| 4,602,818 | A * | 7/1986 | Korn | 297/452.18 |
| 4,640,548 | A | 2/1987 | Desanta | |
| D295,925 | S | 5/1988 | Uredat-Neuhoff | |
| 4,789,203 | A | 12/1988 | Van Zee et al. | |
| 4,790,600 | A * | 12/1988 | Behringer | 297/337 |
| 4,826,247 | A | 5/1989 | McGrady et al. | |
| 4,852,943 | A | 8/1989 | Roper | |
| D309,385 | S | 7/1990 | Buhk | |
| D331,154 | S | 11/1992 | Sheridan | |
| 5,295,755 | A | 3/1994 | DeHaan, III et al. | |
| 5,558,398 | A * | 9/1996 | Santos | 297/284.3 |
| 5,577,803 | A | 11/1996 | Guilbaud | |
| 5,649,740 | A | 7/1997 | Hodgdon | |
| D391,089 | S | 2/1998 | Chu | |
| 5,735,511 | A | 4/1998 | Stocker et al. | |
| D394,961 | S | 6/1998 | Fancelli | |
| 5,769,492 | A | 6/1998 | Jensen | |
| D397,258 | S | 8/1998 | Heyder et al. | |
| D411,395 | S | 6/1999 | Edwards | |
| D419,007 | S | 1/2000 | Chu | |
| 6,019,422 | A | 2/2000 | Taormino et al. | |
| 6,050,646 | A | 4/2000 | Stenzel et al. | |
| D445,579 | S | 7/2001 | Olson | |

(Continued)

FOREIGN PATENT DOCUMENTS

| | | |
|---|---|---|
| DE | 8914349 | 1/1990 |

(Continued)

*Primary Examiner*—Sarah B McPartlin
(74) *Attorney, Agent, or Firm*—Swernofsky Law Group PC

(57) ABSTRACT

An improved chair is disclosed. The chair includes: (i) a seat; (ii) a base portion connected to the bottom of the seat; (iv) an upwardly extending support frame connected to either the seat or the base; and (v) a backrest connected to the support frame by a number of fasteners. The fasteners include a resilient member located between the backrest and the support frame, such that the backrest is spaced apart from the support frame.

10 Claims, 3 Drawing Sheets

U.S. PATENT DOCUMENTS

| | | | | |
|---|---|---|---|---|
| 6,260,921 | B1 | 7/2001 | Chu | |
| D446,955 | S | 8/2001 | Zemp | |
| D455,303 | S | 4/2002 | Ooyama | |
| D459,903 | S | 7/2002 | Lo | |
| D459,923 | S | 7/2002 | Chu | |
| D463,694 | S | 10/2002 | Chu | |
| D473,726 | S | 4/2003 | Schaefer | |
| 6,565,153 | B2 * | 5/2003 | Hensel et al. | 297/285 |
| 6,688,689 | B1 | 2/2004 | Thorn | |
| D488,313 | S | 4/2004 | Seiler | |
| D505,798 | S | 6/2005 | Seiler | |
| D507,437 | S | 7/2005 | Klaasen et al. | |
| D507,438 | S | 7/2005 | Grove | |
| D514,338 | S | 2/2006 | Bellin | |
| D515,339 | S | 2/2006 | Egger | |
| D516,329 | S | 3/2006 | Baeriswyl | |
| 7,008,022 | B2 | 3/2006 | Cassaday | |
| D518,983 | S | 4/2006 | Chu | |
| 7,021,706 | B2 * | 4/2006 | Aufrere et al. | 297/216.14 |
| D523,252 | S | 6/2006 | Rodriguez | |
| D534,383 | S | 1/2007 | Chu | |
| D534,385 | S | 1/2007 | Chu | |
| D534,748 | S | 1/2007 | Chu | |

FOREIGN PATENT DOCUMENTS

| | | |
|---|---|---|
| DE | 29520899 | 7/1996 |
| DE | 29615193 | 11/1996 |
| DE | 29803535 | 5/1998 |
| DE | 10048898 | 5/2002 |
| EP | 0764413 | 3/1997 |
| EP | 0772986 | 5/1997 |
| EP | 0776621 | 6/1997 |
| EP | 0815779 | 1/1998 |
| EP | 0931482 | 7/1999 |
| EP | 0970638 | 1/2000 |
| EP | 0986977 | 3/2000 |
| EP | 1127518 | 8/2001 |
| EP | 1192876 | 4/2002 |
| EP | 1192882 | 4/2002 |

* cited by examiner

CHAIR

FIELD OF THE INVENTION

The invention relates to chairs, and in particular, to an improved backrest for a chair.

BACKGROUND OF THE INVENTION

Chairs with adjustable backrests are well known. Such prior art chairs typically allow the backrest to recline, rise and lower, and the lumbar support to be adjusted. These adjustments are typically enabled by mechanical devices. While such devices permit the backrest to be adjusted in a particular position, the backrest is then locked in the selected position, or its movement is restricted along one or more axes.

Recent research has suggested that it may be beneficial to the musculoskeletal system of a user to continually move while seated. Accordingly, there is a need for an improved chair which encourages the user to continually move, while at the same time providing continuous support by permitting the backrest to move with the user in multiple degrees of freedom.

SUMMARY OF THE INVENTION

According to a first aspect of the present invention, a chair is provided. The chair comprises: (i) a seat; (ii) a base portion connected to the bottom of the seat; (iv) an upwardly extending support frame connected to either the seat or the base; and (v) a backrest connected to the support frame by a plurality of fasteners. The fasteners include a resilient member located between the backrest and the support frame, such that the backrest is spaced apart from the support frame. The resilient members provide the advantage of permitting the backrest to move and adjust, in multiple degrees of freedom, to the movement of the user's back Preferably, three fasteners are arranged in a triangular configuration and include elastomeric members, such as rubber grommets.

According to a second aspect of the present invention, a chair is provided. The chair comprises: (i) a seat; (ii) a base portion connected to the bottom of the seat; (iv) an upwardly extending support frame connected to either the seat or the base; and (v) a backrest connected to the support frame by three fasteners arranged in a triangular configuration. The fasteners include a resilient member located between the backrest and the support frame.

DETAILED DESCRIPTION OF THE PREFERRED EMBODIMENT

Figure 1:
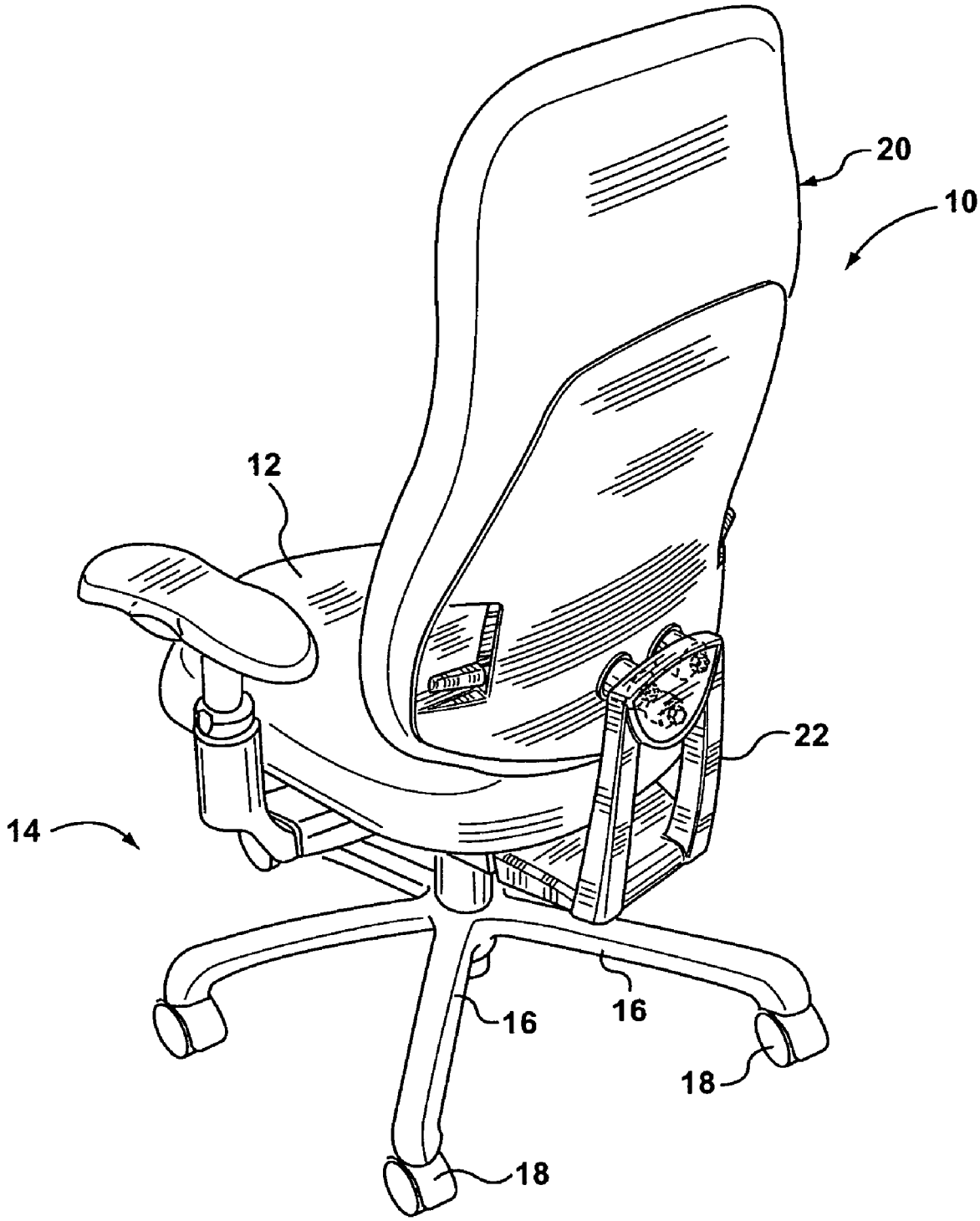
FIG. 1 is a perspective view of a preferred embodiment of the present invention.

FIG. 1 shows a chair 10 according to a preferred embodiment of the present invention. The chair 10 includes a seat 12 which is supported by a base portion 14 connected to the bottom of the seat 12.

The base portion 14 may include any number of conventional components, such as legs 16 and castors 18. The base portion 14 may also include conventional adjustment mechanisms (not shown) to permit the chair 10 to rotate, tilt, or move the seat vertically.

Figure 2:
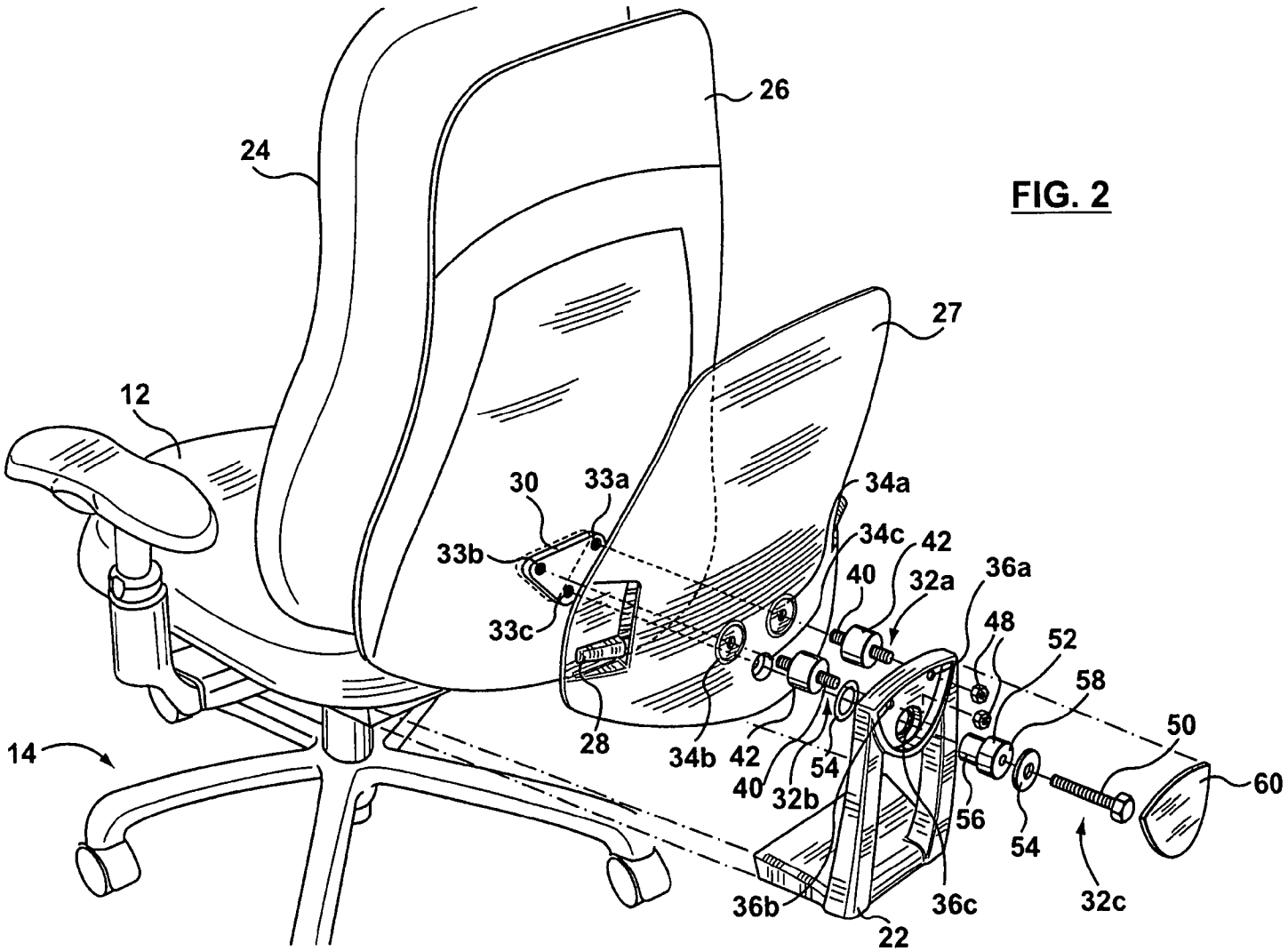
FIG. 2 is an exploded perspective view of the preferred embodiment.

Referring to FIGS. 1 and 2, a backrest 20 is connected to the seat 12 by an upwardly extending support frame 22. Preferably, the support frame 22 is connected to the underside of the seat 12. Alternatively, the support frame 22 may be connected to the base portion 14. The backrest 20 is spaced apart from the support frame 22, as described in more detail below.

Referring to FIGS. 1, and 2, the backrest 20 includes a cushion 24 and a rear cover 27 mounted to front surface and rear surfaces, respectively, of a cushion support 26. The rear cover may include levers 28 for adjustment of a conventional lumbar support mechanism (not shown).

Figure 4:
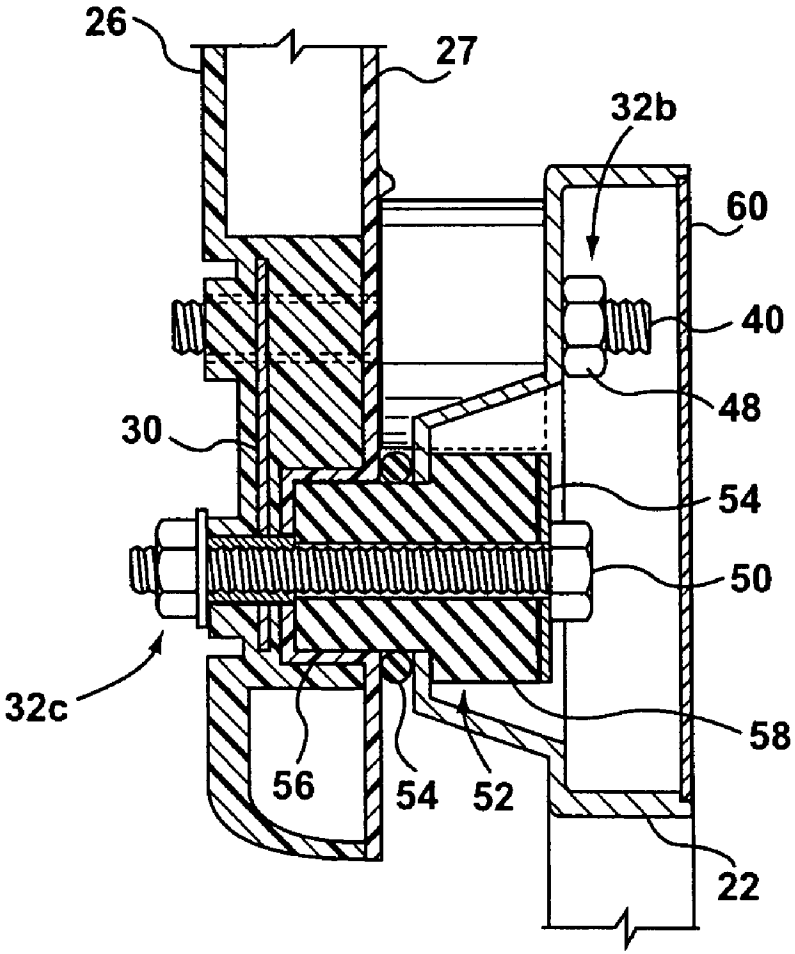
FIG. 4 is a cross-sectional view of a portion of the preferred embodiment along line 4-4 of FIG. 3.
Figure 3:
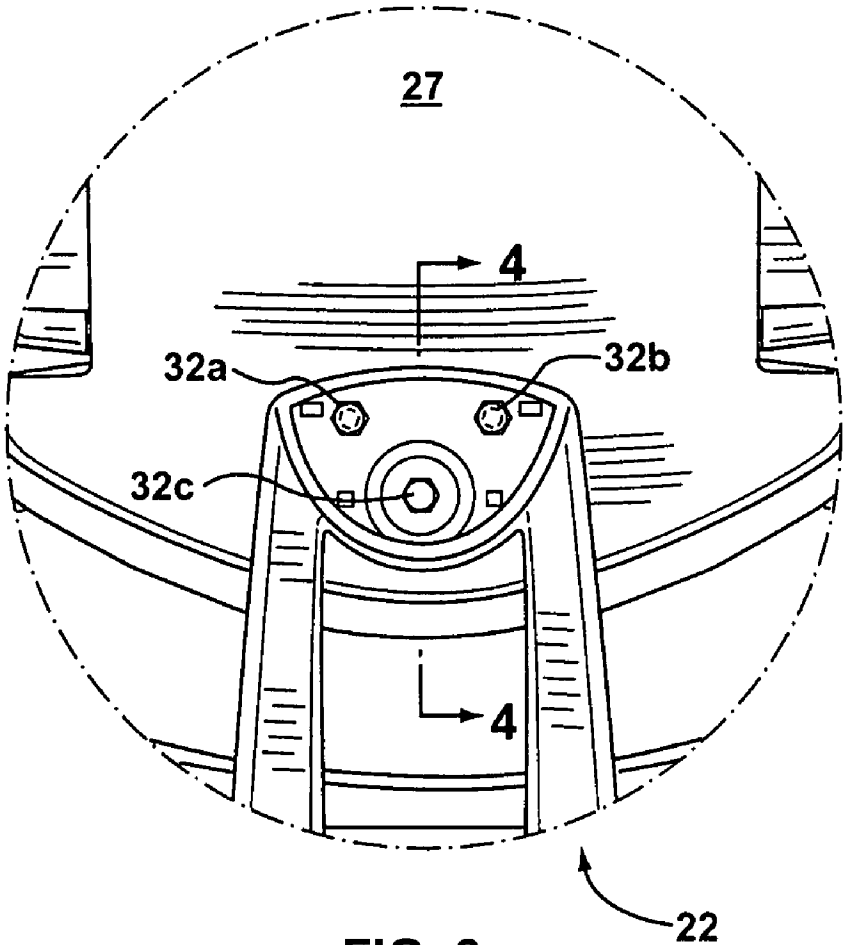
FIG. 3 is a plan view of a portion of the preferred embodiment showing the connection of the support frame to the backrest.

Referring now to FIGS. 2-4, a mounting plate 30 is preferably molded into the cushion support 26. The support frame 22 is connected to the backrest 20 by preferably three fasteners 32*a*, 32*b*, 32*c* which mount into corresponding nuts 33*a*, 33*b*, 33*c* secured to the mounting plate 30 in a conventional manner. The fasteners 32*a*, 32*b*, 32*c* pass through corresponding holes 34*a*, 34*b*, 34*c* in the rear cover 27 and holes 36*a*, 36*b*, 36*c* in the support frame 22.

Preferably, the fasteners 32*a*, 32*b*, and 32*c* are arranged in a triangular configuration. In particular, a pair of fasteners 32*a*, 32*b* are aligned horizontally. The third fastener 32*c* is preferably positioned below the pair of fasteners 32*a*, 32*b* and is horizontally centered between them. In one example, the horizontal distance between the pair of fasteners 32*a*, 32*b* is about 2.9 inches, and the third fastener 32*c* is located about 1.5 inches below the pair of fasteners 32*a*, 32*b*.

Each of the pair of fasteners 32*a*, 32*b* preferably includes a threaded rod 40 on which is mounted a resilient member, such as an elastomeric grommet 42. Preferably, the grommets 42 are composed of rubber, which has a nominal durometer of 58 on the Shore A scale. The rods 40 are mounted into corresponding holes 34*a*, 34*b* and 36*a*, 36*b* of the rear cover 27 and support frame 22, respectively, such that the grommets 42 are positioned between the support frame 22 and the rear cover 27. The threaded rods 40 are secured to the support frame 22 by nuts 48 and to cushion support 26 by nuts 33*a*, 33*b*.

The third fastener 32*c* includes a bolt 50 on which is mounted a third resilient member, such as a cork-shaped elastomeric grommet 52. Preferably, the grommet 52 is composed of rubber.

The grommet 52 is bounded by washers 54 on either side. The bolt 50 is secured within nut 33*c* of mounting plate 30, such that a narrower portion 56 of the grommet 52 is positioned between the rear cover 27 and support frame 22 and a wider portion 58 of the grommet 52 is positioned within hole 36*c* (which is wider than holes 36*a*, 36*b*).

A decorative cover plate 60 is connected to the rear surface of support frame 22.

During operation of the chair 10 according to the preferred embodiment, the pair of grommets 42 and the third grommet 52 in the preferred triangular configuration permit the backrest 20 to move in multiple degrees of freedom to adjust to movements of the user's back.

While the present invention as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims.

The invention claimed is:

1. A chair comprising:

a) a seat;

b) a base portion connected to a bottom portion of the seat;

c) an upwardly extending support frame, the support frame being connected to one of the seat and the base;

d) a backrest connected to the support frame by a plurality of fasteners, wherein each of the plurality of fasteners comprises a resilient member, the resilient members being located between the backrest and the support frame, wherein the backrest is spaced apart from the support frame by the resilient members;

wherein the plurality of fasteners comprises three fasteners arranged in a triangular configuration, wherein one of the three fasteners is a lower fastener located below at least one other of the three fasteners;

wherein the resilient member connected to the lower fastener comprises:

(i) a narrow portion positioned between the backrest and the support frame, the narrower portion passing through a hole in the support frame, and (ii) a wider portion positioned reward of the narrow portion, wherein the wider portion abuts against a shoulder adjacent to the hole in the support frame and does not pass through the hole, wherein the wider portion projects rearward of the hole in the support frame.

2. The chair of claim 1, wherein the resilient member is comprises an elastomeric member.

3. The chair of claim 2, wherein the elastomeric member comprises a grommet mounted on the fastener.

4. The chair of claim 3, wherein the grommet comprises a rubber grommet.

5. The chair of claim 3, wherein a pair of the three fasteners are horizontally aligned and located above the lower fastener.

6. The chair of claim 5, wherein the lower fastener is horizontally centered between the pair of fasteners.

7. The chair of claim 3 wherein the backrest comprises a cushion support and a rear cover connected to a rear surface of the cushion support.

8. The chair of claim 7, further comprising a mounting plate molded to the cushion support, wherein the mounting plate is adapted to secure the three fasteners to the backrest.

9. The chair of claim 8, further comprising three nuts molded in the mounting plate to secure the three fasteners.

10. The chair of claim 8, wherein a first, second, and third holes are defined in the rear cover to receive the three fasteners.

* * * * *